US010600370B2

(12) United States Patent
Lin et al.

(10) Patent No.: US 10,600,370 B2
(45) Date of Patent: Mar. 24, 2020

(54) LOCAL DIMMING SYSTEM ADAPTABLE TO A BACKLIGHT OF A DISPLAY

(71) Applicant: HIMAX TECHNOLOGIES LIMITED, Tainan (TW)

(72) Inventors: Yun-Sheng Lin, Tainan (TW); Li-Chia Chu, Tainan (TW); Ying-Han Yeh, Tainan (TW)

(73) Assignee: Himax Technologies Limited, Tainan (TW)

( * ) Notice: Subject to any disclaimer, the term of this patent is extended or adjusted under 35 U.S.C. 154(b) by 7 days.

(21) Appl. No.: 16/109,426

(22) Filed: Aug. 22, 2018

(65) Prior Publication Data

US 2020/0066214 A1 Feb. 27, 2020

(51) Int. Cl.

*G09G 3/34* (2006.01)
*G09G 3/36* (2006.01)
*G09G 3/20* (2006.01)

(52) U.S. Cl.

CPC ..... *G09G 3/3406* (2013.01); *G09G 3/2059* (2013.01); *G09G 3/36* (2013.01); *G09G 2320/0247* (2013.01); *G09G 2320/064* (2013.01); *G09G 2320/0646* (2013.01); *G09G 2320/0653* (2013.01); *G09G 2320/103* (2013.01); *G09G 2330/021* (2013.01); *G09G 2360/16* (2013.01)

(58) Field of Classification Search

CPC ..... G09G 3/3406; G09G 3/2059; G09G 3/36; G09G 2320/064; G09G 2360/16; G09G 2320/0247; G09G 2320/0646; G09G 2320/103; G09G 2320/0653; G09G 2330/021

See application file for complete search history.

(56) References Cited

U.S. PATENT DOCUMENTS

2008/0042927 A1* 2/2008 Jung ..... G09G 3/3426 345/39
2011/0084987 A1* 4/2011 Kim ..... G09G 3/342 345/690
2012/0133685 A1* 5/2012 Cho ..... G09G 3/3426 345/690
2019/0206335 A1* 7/2019 Wu ..... G09G 3/342

* cited by examiner

*Primary Examiner* — Dmitriy Bolotin
(74) *Attorney, Agent, or Firm* — Donald E. Stout; Stout, Uxa & Buyan, LLP

(57) ABSTRACT

A local dimming system includes a mean estimation unit that estimates a mean value of an image; a PWM gain control unit that generates a PWM gain value according to the mean value; a spatial filter that performs on a plurality of the mean values in spatial domain to enhance a plurality of the PWM gain values, thereby generating enhanced PWM gain values; a scene change detection unit that detects scene change according to a histogram mean value generated by the mean estimation unit; a temporal filter that performs in temporal domain according to the enhanced PWM gain values and a result of scene change detection, thereby generating PWM values; a light shape imitation (LSI) unit that generates luminance gain according to the PWM value; and a pixel compensation unit that performs pixel compensation on the image according to the luminance gain, thereby resulting in a compensated image.

17 Claims, 6 Drawing Sheets

| | | | | |
|---|---|---|---|---|
| HGL0 | HGL0 | HGL0 | HGL1 | HGL2 |
| HGL0 | HGL0 | HGL0 | HGL1 | HGL2 |
| HGL0 | HGL0 | HGL0 | HGL1 | HGL2 |
| HGL48 | HGL48 | HGL48 | HGL49 | HGL50 |
| HGL96 | HGL96 | HGL96 | HGL97 | HGL98 |

FIG. 5A

| | | | | |
|---|---|---|---|---|
| s11 | s12 | s13 | s14 | s15 |
| s21 | s22 | s23 | s24 | s25 |
| s31 | s32 | s33 | s34 | s35 |
| s41 | s42 | s43 | s44 | s45 |
| s51 | s52 | s53 | s54 | s55 |

FIG. 5B

LOCAL DIMMING SYSTEM ADAPTABLE TO A BACKLIGHT OF A DISPLAY

BACKGROUND OF THE INVENTION

1. Field of the Invention

The present invention generally relates to backlight dimming, and more particularly to a local dimming system adaptable to a light-emitting diode backlight of a liquid crystal display.

2. Description of Related Art

As liquid crystal displays (LCDs) do not produce light themselves, a backlight is required to provide illumination to the LCDs. The light source of the backlight may be composed of light-emitting diodes (LEDs).

In order to improve the contrast, a backlight dimming technique is adopted to dynamically control luminance of the backlight. Global dimming is one type of backlight dimming, in which luminance of entire display panel is controlled at the same time. The global dimming can substantially improve dynamic contrast between two consecutive frames. Local dimming is another type of backlight dimming, in which luminance of partial display panel within one frame is controlled. The local dimming can substantially improve static contrast.

Conventional dimming methods, particularly local dimming methods, suffer luminance unevenness and flickers. More importantly, conventional local dimming methods cannot effectively reduce power consumption. A need has arisen to propose a novel scheme to overcome disadvantages of conventional local dimming methods.

SUMMARY OF THE INVENTION

In view of the foregoing, it is an object of the embodiment of the present invention to provide a local dimming system adaptable to a light-emitting diode (LED) backlight of a liquid crystal display (LCD) capable of effectively reducing power consumption. The local dimming system of one embodiment is capable of adjusting dimming speed and preventing flicker.

According to one embodiment, a local dimming system adaptable to a backlight of a display includes a mean estimation unit, a pulse-width modulation (PWM) gain control unit, a spatial filter, a scene change detection unit, a temporal filter, a light shape imitation (LSI) unit and a pixel compensation unit. The mean estimation unit receives an image and estimates a mean value thereof. The PWM gain control unit generates a PWM gain value according to the mean value. The spatial filter performs on a plurality of the mean values in spatial domain to enhance a plurality of the PWM gain values, thereby generating enhanced PWM gain values. The scene change detection unit detects scene change according to a histogram mean value generated by the mean estimation unit. The temporal filter performs in temporal domain according to the enhanced PWM gain values and a result of scene change detection, thereby generating PWM values. The LSI unit generates luminance gain according to the PWM value. The pixel compensation unit performs pixel compensation on the image according to the luminance gain, thereby resulting in a compensated image.

BRIEF DESCRIPTION OF THE DRAWINGS

FIG. 5A shows exemplary PWM gain values; and

FIG. 5B shows corresponding elements of a spatial filter to be performed on the PWM gain values of FIG. 5A.

DETAILED DESCRIPTION OF THE INVENTION

Figure 1:
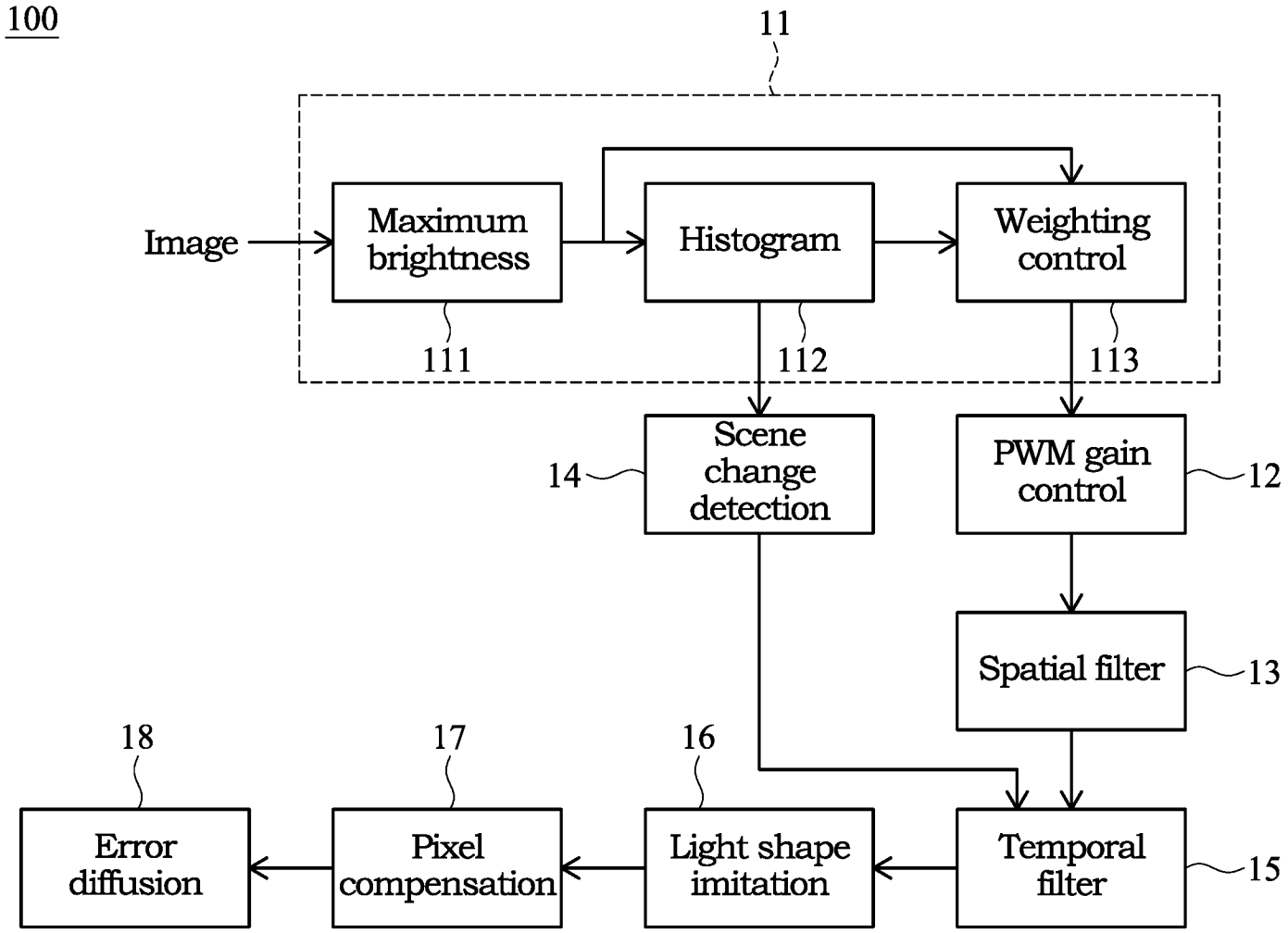
FIG. 1 shows a block diagram illustrating a local dimming system adaptable to a light-emitting diode (LED) backlight of a liquid crystal display (LCD) according to one embodiment of the present invention.

FIG. 1 shows a block diagram illustrating a local dimming system 100 adaptable to a light-emitting diode (LED) backlight of a liquid crystal display (LCD) according to one embodiment of the present invention. The blocks of the local dimming system 100 may be implemented by hardware (e.g., a digital image processor), software (e.g., computer programs) or their combinations.

Figure 2:
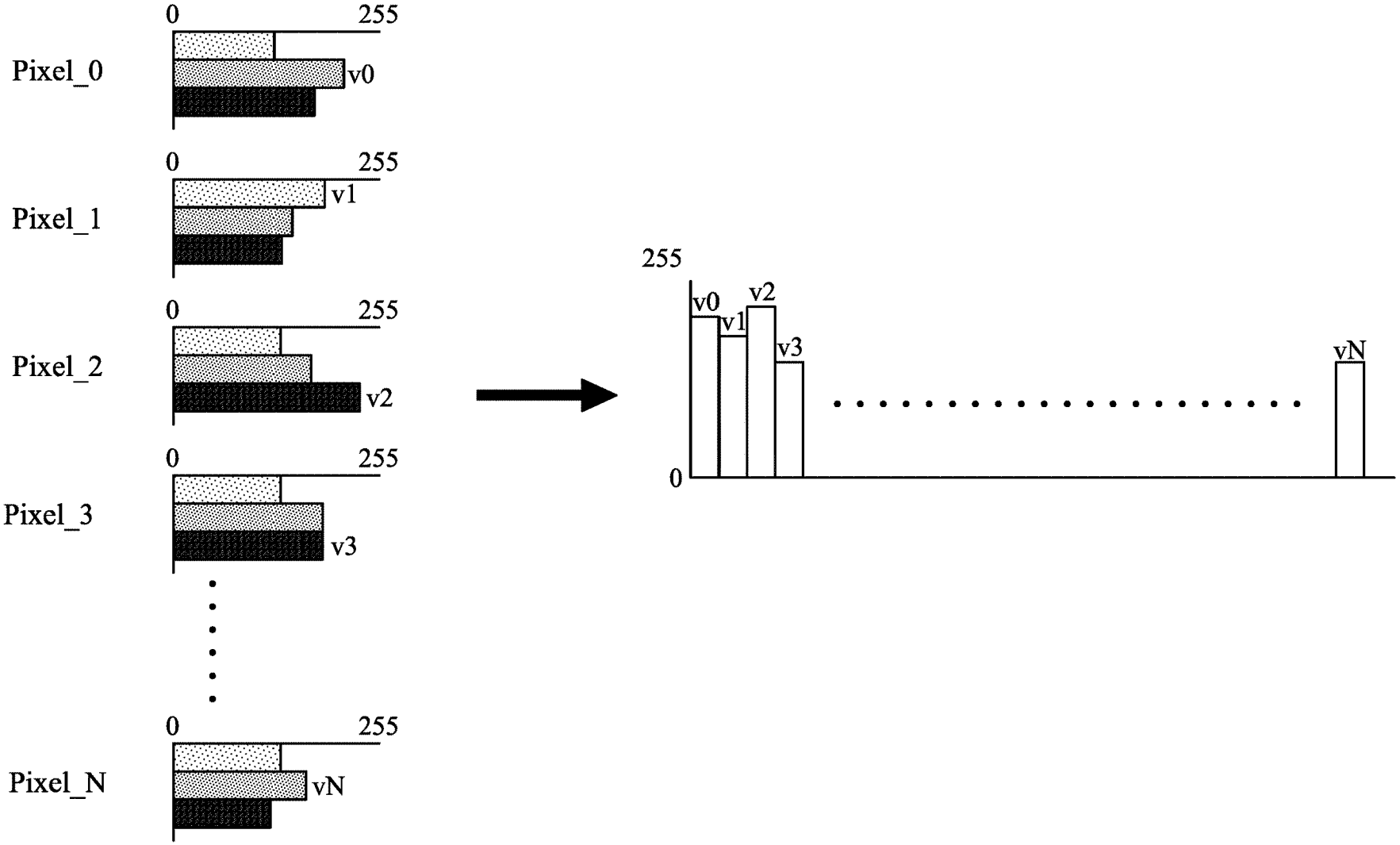
FIG. 2 schematically shows an example of determining maximum brightness of each pixel of the image.

In the embodiment, the local dimming system 100 may include a mean estimation unit 11 configured to receive an image and estimate a mean value thereof. According to one aspect of the embodiment, the mean value may be estimated according to a histogram of the image. Specifically, the mean estimation unit 11 may include a maximum brightness unit 111 configured to determine maximum brightness of each pixel of the image regardless of colors (e.g., red, green and blue). FIG. 2 schematically shows an example of determining maximum brightness of each pixel of the image. As exemplified in FIG. 2, maximum brightness (e.g., v0 for pixel 0, v1 for pixel 1, etc.) of each pixel is determined, and may be demonstrated by a bar graph on the right-hand side. Accordingly, an arithmetic mean value $HGL_{mean}$ may be obtained as follows:

$$HGL_{mean} = \text{floor}\left(\frac{v0 + v1 + v2 + v3 + \ldots + v(N-1)}{N}\right)$$

where floor represents a floor function that takes an input and gives an output the greatest integer that is less than or equal to the input.

Figure 3:
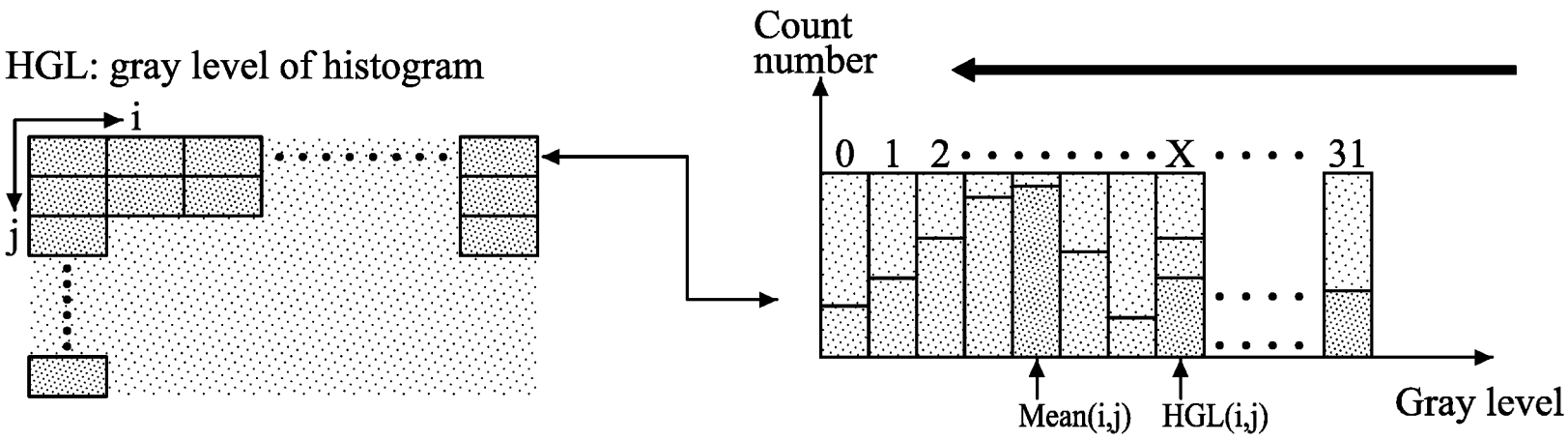
FIG. 3 schematically shows an example of generating a histogram mean value according to the histogram of the image.

The mean estimation unit 11 may include a histogram unit 112 configured to generate a histogram mean value according to the histogram of the image. FIG. 3 schematically shows an example of generating a histogram mean value according to the histogram of the image. As exemplified in FIG. 3, the image is divided into a plurality of blocks, gray levels of which construct a histogram on the right-hand side. The divided blocks may correspond to LEDs of the LED backlight. Next, counts of the gray levels are accumulated from the highest gray level toward the lowest gray level until a predetermined threshold has reached, where the corresponding gray level is set as the histogram mean value $HGL_{high}$, which may be expressed as follows:

$$\text{if } S31+S30+\ldots+Sn \geq \text{threshold then } HGL_{high}=n$$

The mean estimation unit 11 may include a weighting control unit 113 configured to generate the mean value. In the embodiment, the mean value is generated according to the arithmetic mean value $HGL_{mean}$ and the histogram mean value $HGL_{high}$. In one exemplary embodiment, the mean value $HGL_{out}$ may be expressed as follows:

$$HGL_{out} = \max\left(HGL_{mean}, \frac{w_1 \times HGL_{high} + w_2 \times HGL_{mean}}{16}\right)$$

where max is a function that takes two inputs and gives an output the greatest value between the two inputs, and $w_1$ and $w_2$ are weights.

Figure 4A:
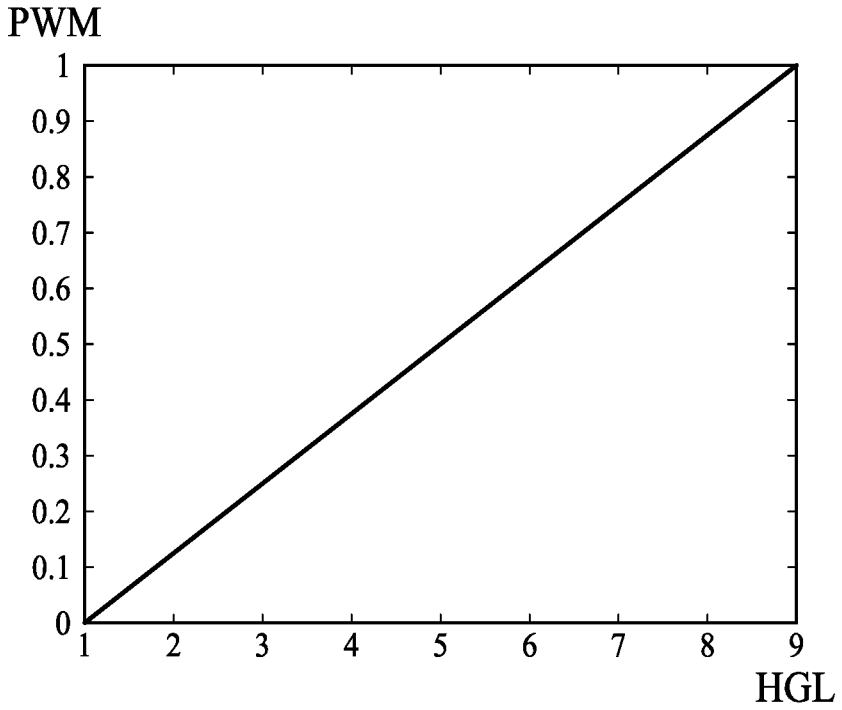
FIG. 4A to FIG. 4C show exemplary relation curves between PWM gain value and mean value.
Figure 4B:
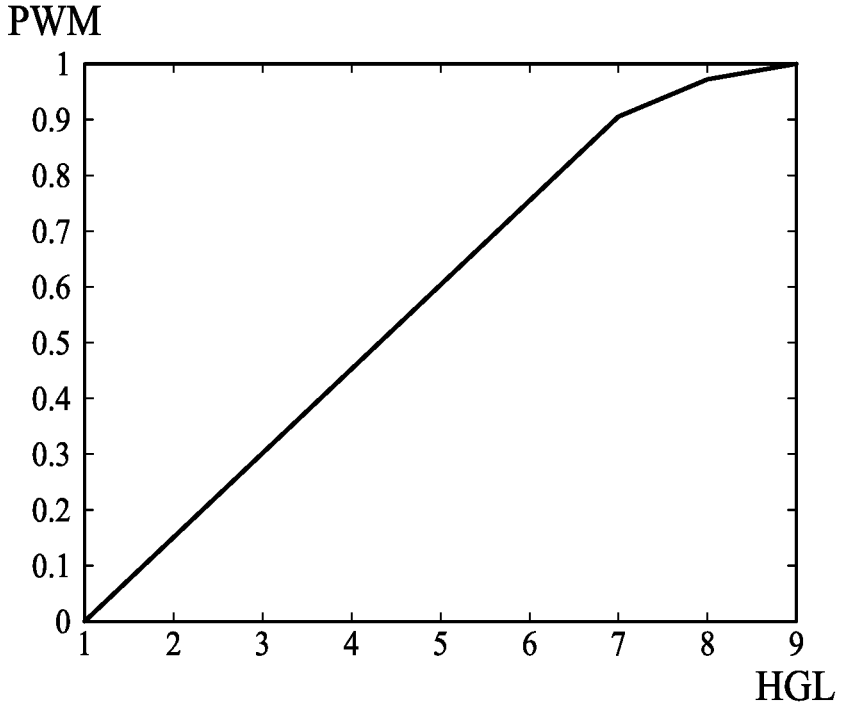
Figure 4C:
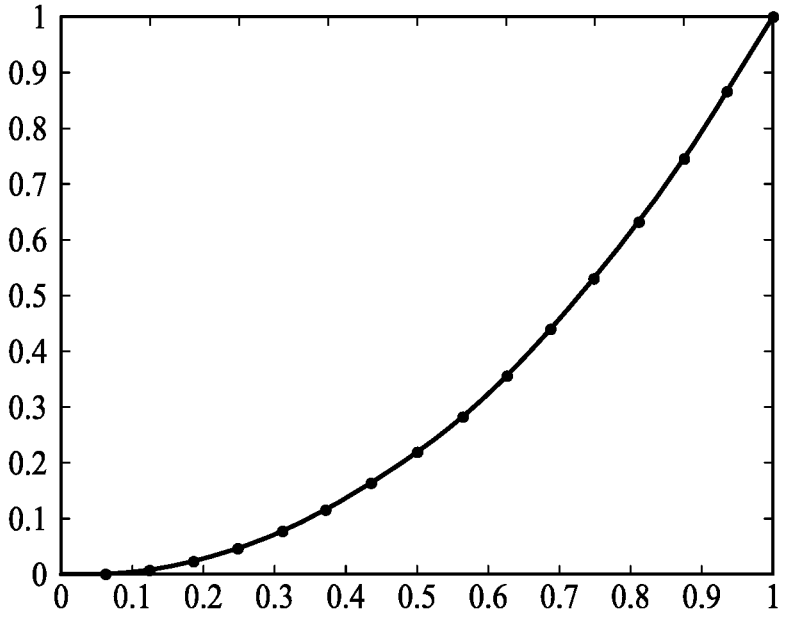

The local dimming system 100 of the embodiment may include a pulse-width modulation (PWM) gain control unit 12 configured to generate PWM gain value according to the mean value (from the mean estimation unit 11). The PWM gain value is used to control power supplied to the LED backlight. The larger the PWM gain value is, the higher the total power supplied to the LED backlight. FIG. 4A shows an exemplary relation curve between PWM gain value and mean value. In this example, linearity exists between PWM gain value and mean value. FIG. 4B shows another exemplary relation curve between PWM gain value and mean value. Linearity also exists in this example except smooth rise at high value. FIG. 4C shows a further exemplary relation curve between PWM gain value and mean value, illustrating nonlinearity of gamma correction. In one embodiment, the PWM gain value may be generated according to a lookup table that is created beforehand, thus saving runtime computation.

The local dimming system 100 of the embodiment may include a spatial filter 13 configured to be performed on the mean values HGL in spatial domain to enhance the PWM gain values, thereby generating enhanced PWM gain values. FIG. 5A shows exemplary PWM gain values and FIG. 5B shows corresponding elements of a spatial filter to be performed on the PWM gain values of FIG. 5A. In one exemplary embodiment, spatial filtering may be performed to generate enhanced PWM gain value HGL' in companion with FIG. 5A and FIG. 5B as follows:

$$\mathrm{HGL}'_\mathrm{tmp1} = \frac{[HGL0\ HGL0\ HGL0\ HGL2\ \ldots\ HGL97\ HGL98]\begin{bmatrix} s11 \\ s12 \\ s13 \\ s14 \\ s15 \\ \vdots \\ s54 \\ s55 \end{bmatrix}}{256}$$

$$\text{if } \mathrm{HGL}'_\mathrm{tmp1} \geqq 255 \text{ then } \mathrm{HGL}'_\mathrm{temp1} = 255$$

$$\mathrm{HGL}'_\mathrm{tmp2} = \mathrm{Max}(HGL0, HGL1, \ldots\ HGL98)$$

$$\mathrm{HGL}'_\mathrm{tmp} = \frac{\mathrm{wt} \times \mathrm{HGL_tmp2} + (32 - \mathrm{wt}) \times \mathrm{HGL_tmp1}}{32}$$

$$\text{if } \mathrm{HGL}'_\mathrm{tmp} < HGL \text{ then } HGL' = HGL$$

$$\text{else } HGL' = \mathrm{HGL}'_\mathrm{tmp}$$

The local dimming system 100 of the embodiment may include a scene change detection unit 14 configured to detect scene change according to the histogram mean value (from the histogram unit 112).

The local dimming system 100 of the embodiment may include a temporal filter 15 configured to be performed in temporal domain according to the enhanced PWM gain value (from the spatial filer 13) and a result of scene change detection (from the scene change detection unit 14) for the purpose of adjusting dimming speed and preventing flicker (i.e., flickerless), thereby generating PWM values.

According to another aspect of the embodiment, the temporal filter 15 may provide power constraint mode, by which the PWM value may be constrained (or limited) by a maximum value. In the embodiment, the PWM value may be constrained according to a sum of PWM values respectively corresponding to LEDs of the LED backlight.

The local dimming system 100 of the embodiment may include a light shape imitation (LSI) unit 16 configured to generate luminance gain according to the PWM value (from the temporal filter 15), and include a pixel compensation unit 17 configured to perform pixel compensation on the image according to the luminance gain (from the LSI unit 16), thereby resulting in a compensated image. The luminance gain may be expressed as follows:

$$\text{Luminance gain} = (\text{luminance})^{(-1/r)}$$

where r is Gamma value.

In one embodiment, the PWM values are subjected to weighting before feeding to the LSI unit 16 in peaking mode. Suppose current in normal (or original) mode is original_I, current in peaking mode is peaking_I, and PWM value in normal mode is original_PWM, a PWM value in peaking mode denoted as peaking_PWM may be expressed as follow:

$$\text{peaking_PWM} = \frac{\text{peaking_I}}{\text{original_I}} \times \text{original_PWM}$$

where (peaking_I/original_I) is a peaking weight.

The local dimming system 100 of the embodiment may include an error diffusion unit 18 configured to perform error diffusion on the compensated image. The error diffusion may be performed by truncating at least one least significant bit (LSB), for example, truncating 14 bits to 12 bits, of the compensated image. Accordingly, contour effect may be substantially reduced to improve picture quality.

Although specific embodiments have been illustrated and described, it will be appreciated by those skilled in the art that various modifications may be made without departing from the scope of the present invention, which is intended to be limited solely by the appended claims.

What is claimed is:

1. A local dimming system adaptable to a backlight of a display, the system comprising:

a mean estimation unit that receives an image and estimates a mean value thereof;

a pulse-width modulation (PWM) gain control unit that generates a PWM gain value according to the mean value;

a spatial filter that performs on a plurality of the mean values in spatial domain to enhance a plurality of the PWM gain values, thereby generating enhanced PWM gain values;

a scene change detection unit that detects scene change according to a histogram mean value generated by the mean estimation unit;

a temporal filter that performs in temporal domain according to the enhanced PWM gain values and a result of scene change detection, thereby generating PWM values;

a light shape imitation (LSI) unit that generates luminance gain according to the PWM value; and a pixel compensation unit that performs pixel compensation on the image according to the luminance gain, thereby resulting in a compensated image.

2. The system of claim 1, wherein the mean value is estimated according to a histogram of the image.

3. The system of claim 1, wherein the backlight comprises a light-emitting diode (LED) backlight.

4. The system of claim 3, wherein the mean estimation unit comprises a maximum brightness unit that determines maximum brightness of each pixel of the image, according to which an arithmetic mean value is obtained.

5. The system of claim 4, wherein the mean estimation unit comprises a histogram unit that generates the histogram mean value according to a histogram of the image.

6. The system of claim 5, wherein the histogram mean value is generated by the following steps:

dividing the image into a plurality of blocks, gray levels of which construct the histogram of the image, the divided blocks corresponding to LEDs of the LED backlight; and accumulating counts of the gray levels from a highest gray level toward a lowest gray level until a predetermined threshold has reached, where corresponding gray level is set as the histogram mean value.

7. The system of claim 4, wherein the mean estimation unit comprises a weighting control unit that generates the mean value according to the arithmetic mean value and the histogram mean value.

8. The system of claim 7, wherein the mean value is a greatest value between the arithmetic mean value and a weighted sum of the histogram mean value and the arithmetic mean value.

9. The system of claim 3, wherein the PWM gain value is used to control power supplied to the LED backlight, the larger the PWM gain value is, the higher the power supplied to the LED backlight.

10. The system of claim 3, wherein the temporal filter provides power constraint mode, by which the PWM value is constrained by a maximum value.

11. The system of claim 10, wherein the PWM value is constrained according to a sum of PWM values respectively corresponding to LEDs of the LED backlight.

12. The system of claim 1, wherein the PWM gain value is generated according to a lookup table containing a plurality of PWM gain values and corresponding mean values.

13. The system of claim 1, wherein the PWM values are subjected to weighting before feeding to the LSI unit in peaking mode.

14. The system of claim 13, wherein the PWM value in the peaking mode denoted as peaking_PWM is expressed as follow:

$$\text{peaking_PWM} = \frac{\text{peaking_I}}{\text{original_I}} \times \text{original_PWM}$$

where original_I is current in original mode, peaking_I is current in the peaking mode, and original_PWM is PWM value in the original mode, and (peaking_I/original_I) is a peaking weight.

15. The system of claim 1, further comprising an error diffusion unit that performs error diffusion on the compensated image.

16. The system of claim 15, wherein the error diffusion unit performs error diffusion by truncating at least one least significant bit (LSB) of the compensated image.

17. The system of claim 1, wherein the display comprises a liquid crystal display (LCD).

* * * * *